US005551153A

United States Patent [19]

Simms

[11] Patent Number: 5,551,153

[45] Date of Patent: Sep. 3, 1996

[54] RAZOR BLADE ASSEMBLY

[75] Inventor: Graham J. Simms, Brookline, Mass.

[73] Assignee: The Gillette Company, Boston, Mass.

[21] Appl. No.: 400,428

[22] Filed: Mar. 3, 1995

Related U.S. Application Data

[63] Continuation of Ser. No. 927,424, filed as PCT/US91/03751, May 28, 1991, published as WO91/19596, Dec. 26, 1991, abandoned.

[30] Foreign Application Priority Data

Jun. 12, 1990 [GB] United Kingdom ..... 9013047

[51] Int. Cl.[6] ..... B26B 21/30; B26B 21/44; B26B 21/16

[52] U.S. Cl. ..... 30/041; 30/50; 30/58; 30/84; 30/346.59; 30/346.60; 30/346.61

[58] Field of Search ..... 30/32, 34.2, 41, 30/41.5, 48, 50, 58, 57, 84, 346.58, 346.59, 346.60, 346.61

[56] References Cited

U.S. PATENT DOCUMENTS

| | | | |
|---|---|---|---|
| 1,169,637 | 1/1916 | Grove | 30/41 |
| 1,844,702 | 2/1932 | Testi | 30/346.61 X |
| 1,909,120 | 5/1933 | Thompson | 30/346.61 X |
| 1,947,633 | 2/1934 | Adams | 30/346.61 X |
| 2,035,111 | 3/1936 | Behrman | 30/50 X |
| 2,335,990 | 12/1943 | Auerbach | 30/346.61 X |
| 2,375,444 | 5/1945 | Schwartz | 30/41 |
| 2,658,271 | 11/1953 | Bronish | 30/346.61 X |
| 3,262,206 | 7/1966 | Tomek | 30/346.59 X |
| 3,872,588 | 3/1975 | Bogaty | 30/50 |
| 3,889,369 | 6/1975 | Ferraro | 30/50 X |
| 3,889,370 | 6/1975 | Hale, III | 30/50 X |
| 3,938,250 | 2/1976 | Perry | 30/50 X |
| 4,314,404 | 2/1982 | Ruiz et al. | 30/41 |
| 4,443,940 | 4/1984 | Francis et al. | 30/87 X |
| 4,574,476 | 3/1986 | Oritz | 30/47 |
| 4,586,255 | 5/1986 | Jacobson | 30/41 |
| 4,624,051 | 11/1986 | Apprille, Jr. et al. | 30/41 X |
| 4,683,096 | 7/1987 | Ferraro | 30/41 X |
| 4,697,342 | 10/1987 | Ferraro | 30/41 |
| 4,813,131 | 3/1989 | Gruner | 30/50 |
| 4,866,844 | 9/1989 | Burout, III | 30/50 |
| 4,875,287 | 10/1989 | Creasy et al. | 30/41 X |
| 4,932,123 | 6/1990 | Francis | 30/57 X |
| 5,010,646 | 4/1991 | Neamtu | 30/50 |
| 5,134,775 | 8/1992 | Althaus et al. | 30/41.5 X |
| 5,224,267 | 7/1993 | Simms et al. | 30/50 |

FOREIGN PATENT DOCUMENTS

| | | | |
|---|---|---|---|
| 1456202 | 11/1976 | United Kingdom | 30/346.59 |

*Primary Examiner*—Rinaldi I. Rada
*Assistant Examiner*—Clark F. Dexter
*Attorney, Agent, or Firm*—Edward S. Podszus; Donal B. Tobin

[57] ABSTRACT

A twin-blade assembly is formed from two blade steel members (A, B) shaped to have rear mounting legs (3A/B), spring arms (9A, 9B) at opposite ends of the unit, down-turned legs (2A, 2B) for reinforcing the members and sharpened blade edges (1A, 1B) on blade strips or margins (5A, 5B). The spring arms can flex to permit relative displacement of the strips (5A, 5B). The assembly may also incorporate a lubricating strip (M), the whole unit and strip being discardable and replaceable as a unit.

10 Claims, 6 Drawing Sheets

RAZOR BLADE ASSEMBLY

This application is a continuation of Ser. No. 07/927,424, filed as PCT/US91/03751 on May 28, 1991 and published as WO91/19596 on Dec. 26, 1991, now abandoned.

There are two main types of safety razor employing replaceable blades currently in use throughout the world.

The first type is the so-called "three piece razor" in which a double edged wafer blade is clamped in use between a blade cap and a blade platform at the upper end of a handle. When the blade is to be replaced, the razor is dismantled and the blade is removed and discarded. It has also been known to provide a razor with a replaceable tandem blade unit including two blades fastened together with fixed edges.

In the second class of safety razor, which is enjoying widespread and increasing popularity in the market, two single-edged blades arranged in a tandem pair are permanently incorporated in a razor head fabricated from a number of plastics components to form a "cartridge" which is detachably mounted on a razor handle and removed complete for discarding when its blade edges have become dulled.

By contrast, the present invention provides a twin-blade assembly comprising two blade members secured either permanently or detachably, for mounting, and replacement, as a unit, in a razor head, wherein at least one blade member is resiliently flexible to allow the relative positions of the blade edges to be set upon mounting the assembly in the razor head.

With the assembly of the invention the blade members do not need to be accurately preset and the desired positions of the blade edges can be established by the razor head, which facilitates manufacture and accurate positioning of the edges with respect to the guard and cap provided on the razor head.

The construction of the blade assembly also has ecological advantages in that it can avoid the need to discard the blades with plastics cartridge components which are not biodegradable.

The twin blade assemblies of the invention may also include a strip of lubricating material e.g. of known form comprising a polymeric matrix and a hydrophilic material which forms a lubricant between the skin and the razor head in use.

BRIEF DESCRIPTION OF THE DRAWINGS

Some presently preferred forms of twin-blade assembly in accordance with the invention and razor heads in which they can be used will now be described, by way of example, with reference to the accompanying drawings, in which.

DETAILED DESCRIPTION OF THE INVENTION

Figure 1:
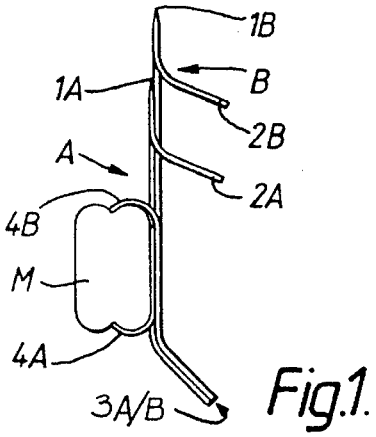
FIG. 1 is an end view of a twin blade assembly in accordance with the invention.
Figure 2:
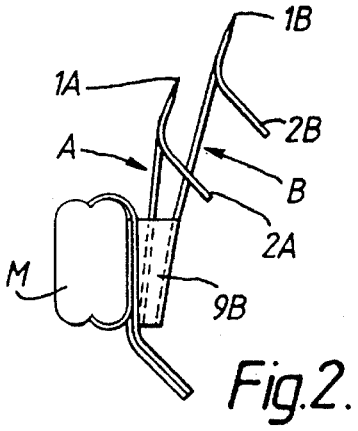
FIG. 2 shows the same assembly in the form it assumes when assembled in a razor head.

FIGS. 1 and 2 show a blade assembly comprising two separately formed blade members A and B, having sharpened cutting edges 1A, 1B, downturned legs 2A, 2B, a rear leg 3AB and clip portions 4A, 4B for retaining a strip of lubricating material M of the type described above.

The assembly is shown in FIG. 1 in its free condition ready for insertion in a razor head, and in FIG. 2 mounted in a head in which the forward portions of the blade members are resiliently deflected to set the required attitudes and spacing, or span, of the edges 1A, 1B.

Figure 3:
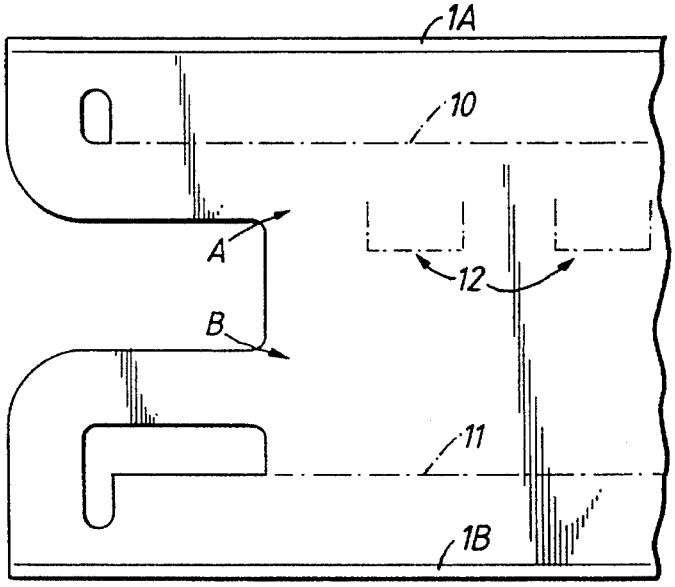
FIGS. 3–8 illustrate various stages in the manufacture of the assembly.

FIG. 3 shows one end portion of a flat blank of blade steel from which two members A and B are formed. The blank is stamped and perforated, and its opposed longitudinal edges are sharpened and honed to form the cutting edges 1A, 1B. Broken line 10, 11 and 12 indicate the positions of subsequent shearing lines.

Figure 4:
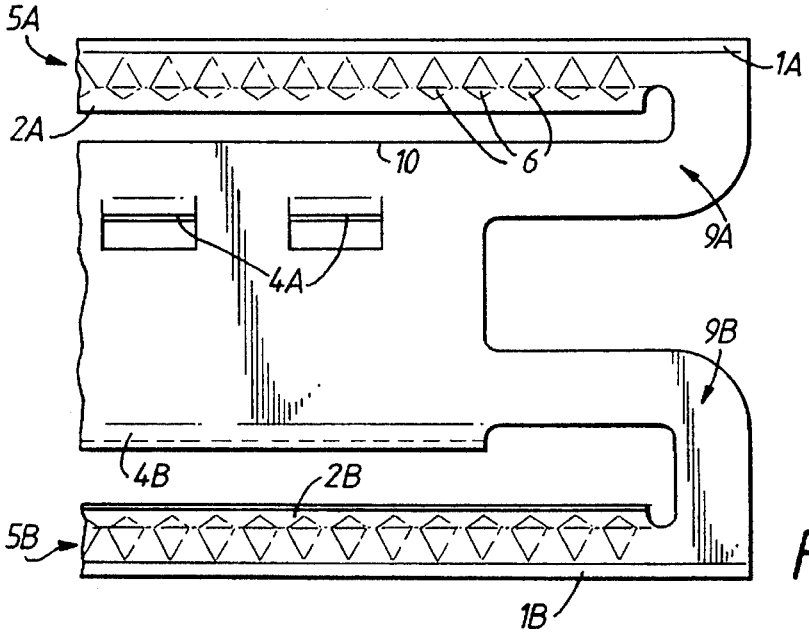

The blank is coated and sintered in the conventional fashion. As shown in FIG. 4, several operations are now performed. The blank is sheared along the lines 10, 11 and 12. Outboard of the shear lines 10 and 11, the legs 2A and 2B are bent out of plane of the strip to give adequate stiffness to the outer margins, or blade strips 5A, 5B, which may be further stiffened by local deformations by indenting diamond patterns 6 as the bends are made. Leg 2A is bent down (relative to the plane of the paper and leg 2B is bent up.

Figure 5:
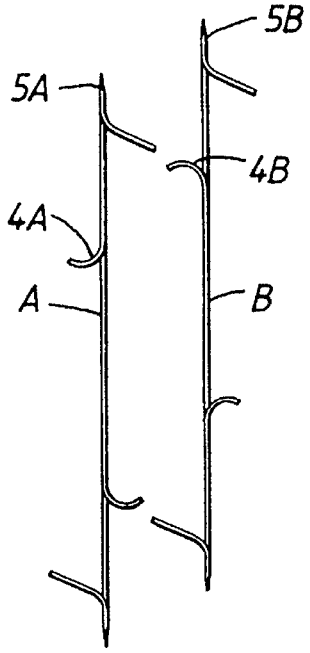
Figure 6:
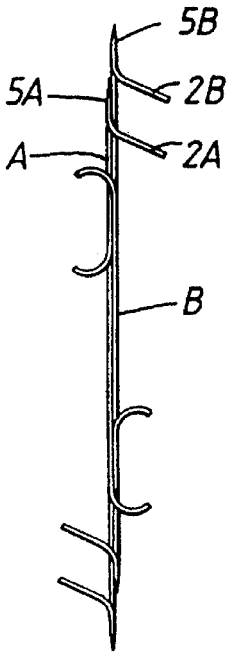
Figure 7:
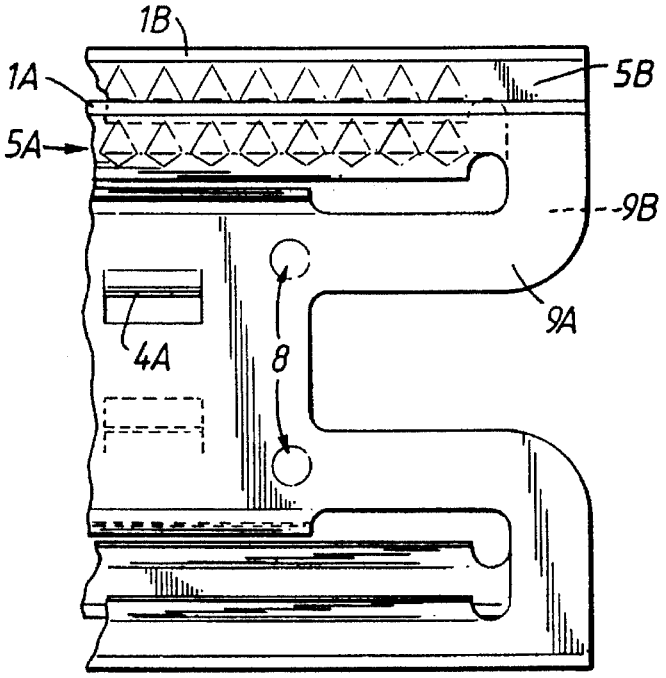

Two such blanks are then brought together as shown in FIGS. 5 and 6, spot welded (or otherwise permanently united) as indicated at 8 in FIG. 7 and the assembly is now severed along its longitudinal center line to form two twin-blade assemblies.

Figure 8:
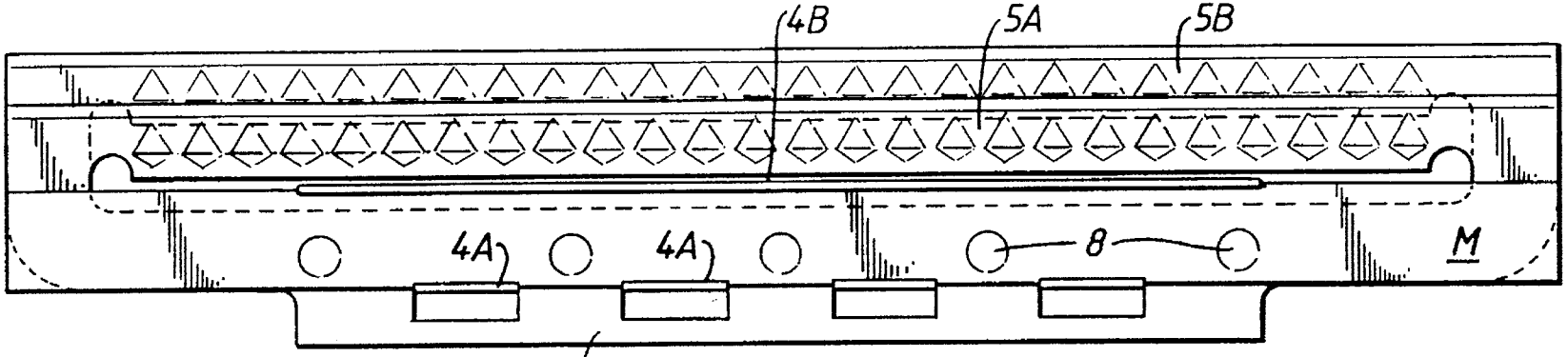

FIG. 8 shows an assembly complete with its strip M inserted and retained in the clips 4A, 4B. In use, the assembly will be firmly supported along the length of the rear leg 3A/B, but the blade strips 5A, 5B are connected to the rear portion of the unit by respective resilient L-shaped arms 9A, 9B which permit the strips 5A, 5B to be displaced essentially about axes parallel with the blade edges 1A, 1B, by resilient deflection of the arms 9A, 9B to the position shown in FIG. 2.

Figure 9:
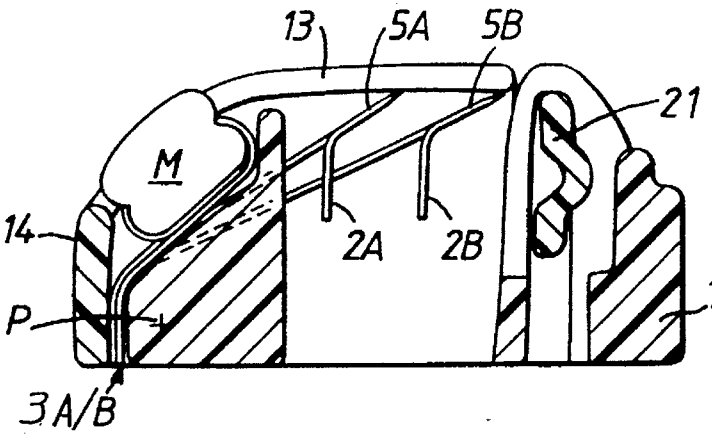
FIG. 9 is a cross-section of a razor head incorporating the twin-blade assembly of FIGS. 1 and 2.

FIG. 9 shows, somewhat diagrammatically, a razor head specifically designed to receive the above described assembly. It comprises a moulded frame 20 carrying a guard bar 21 and cap member comprising a pair of end walls 13 integrally united by a rear bar 14 and pivotally mounted on the frame 20 at a pivot axis P. The cap member is hinged rearwardly (counter-clockwise in FIG. 9) to open the razor head and thus permit insertion of a blade assembly with its rear leg 3A/B against the back of the frame. The cap is then returned to the closed position indicated, the cap thus bearing against the extreme ends of the blade strips 5A, 5B to hold them in their required attitudes for shaving with the required span, or spacing, between the respective blade edges 1A, 1B.

The head may be designed to clamp the blade strips in this position, or it may permit their movement, independently of each other, against the restoring actions of the spring arms 9A, 9B in directions substantially perpendicular to the skin surface being shaved.

It will be understood that when the blade assembly is mounted in the razor head the required attitudes, or more precisely the blade tangent angles, of the blade strips 5A, 5B, and the respective spans between the leading blade edge 1B and the guard bar 21 and between the two blade edges 1A, 1B, will be determined primarily by the lengths of the blade members A, B in relation to the end walls 13 of the cap member when the cap member is in the closed position.

Figure 10:
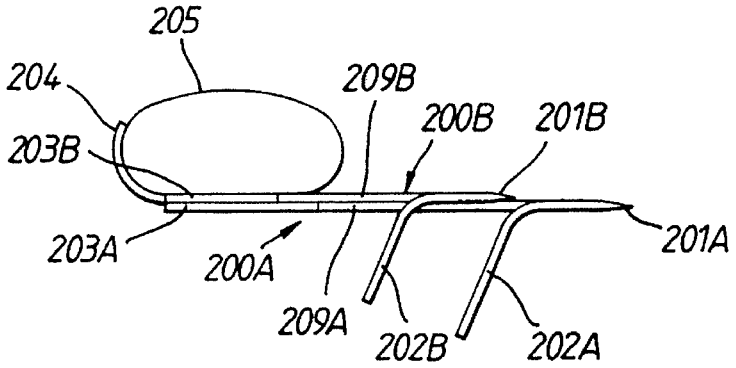
FIG. 10 is an end elevation of a modified form of twin blade assembly.

FIG. 10 illustrates in end elevation a slightly modified twin blade assembly in which the optional lubricating strip 205 is retained against rear supports 204 found only on the upper blade member 200B, the strip 205 being secured to the member 200B with adhesive.

Figure 11:
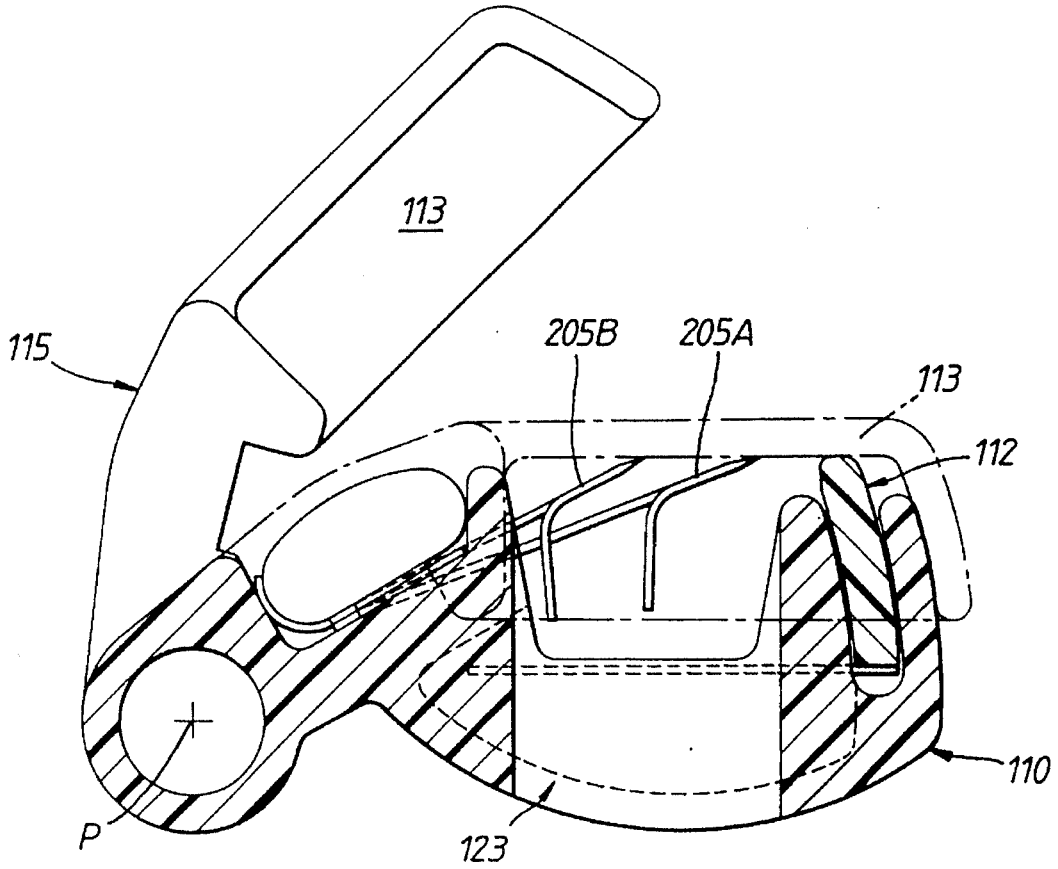
FIG. 11 is a cross-section of a razor head incorporating the assembly of FIG. 10.

FIG. 11 illustrates a razor head utilizing the twin blade assembly of FIG. 10, the razor head being generally similar to that of FIG. 9. The main body 110 of the head is provided with arcuate bearing means 123 by which the head is attached to a razor handle for limited rocking movement about an axis parallel with the blade edges and close to them. The body 110 carries a spring loaded guard member 112 which is biassed upwardly, i.e. against the skin, in use but which can be deflected downwardly in response to reaction forces encountered during shaving.

A cap member 115 is pivotable about a pivot axis P between an open position, illustrated in full lines in FIG. 11, and a closed operative position (shown in broken lines) in which inner flanges on the end walls 113 engage the blade edges and force the blade strips 205A, 205B into their normal operative positions, against the resilient restoring forces applied by the spring arms 209A, 209B. The arms may be deflected further in use of the razor, in response to the varying reaction forces applied to the blade edges as they pass over the skin surfaces being shaved.

Figure 12:
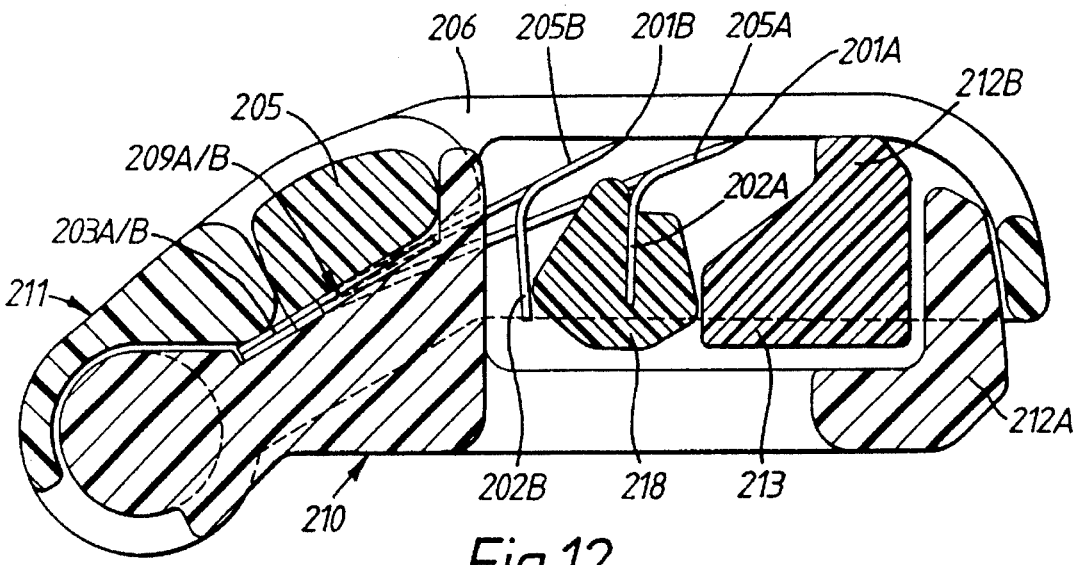
FIGS. 12 and 13 are cross sections of another form of razor head incorporating the blade unit of FIG. 10.
Figure 13:
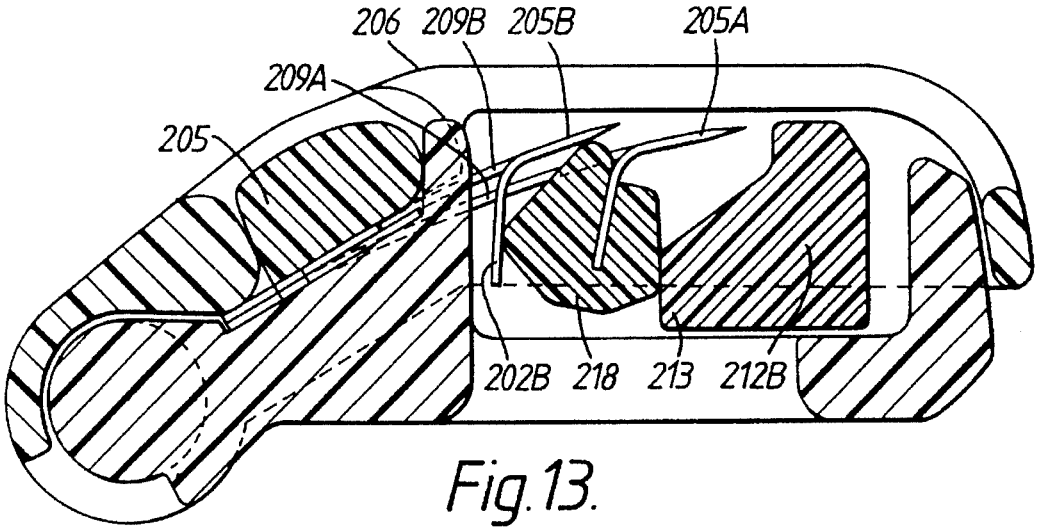

The razor illustrated in FIG. 12 and 13 is generally similar to that of FIG. 11, but in this razor head, provision is made for the guard member 212B to be resiliently displaced downwardly and rearwardly when subject to normal and drag forces encountered in use. The twin blade assembly of FIG. 10 is shown mounted in a razor frame 210 having a pivotable cap 211 with end walls 206. When the cap position is closed, as shown in FIG. 12, the rear margins 203A/B of the blade member are turned down and clamped, the blade strips 205A, 205B being retained at their sharpened edges by the flanges on end walls 206 against which they are spring loaded by the strain energy in spring arms 209A, 209B.

The guard portion 212B is spring loaded upwardly and forwardly (i.e. upwardly and to the right as viewed in FIGS. 12 and 13) but is displaceable against the spring forces, both downwardly in response to normal forces and rearwardly in response to drag forces acting essentially in opposition to the direction of shaving.

In its medial region guard portion 212B has a rearwardly extending bumper 213 engageable with a bumper 218 which is attached to the leg 202A of the leading blade member and which is engageable in turn with the leg 202B of the rear blade member. If the guard portion 212B is displaced a sufficient distance rearwardly, as when encountering high drag forces, its bumper 213 engages the bumper 218 which in turn engages the leg 202B, causing both legs to be tilted rearwardly with concomitant flexure of the spring and 209A/B and consequent angling of the blade strip portions 205A/B in a clockwise sense, i.e. downwardly and forwardly, to reduce their respective shaving angles.

Some further possible variations in the twin blade assemblies are illustrated somewhat diagrammatically in FIG. 14 to 19 all being concerned with different means of stiffening the blade strips and particularly to increase their resistance to bending between their ends.

In each case, the respective blade members are indicated as A and B, with their blade strips at 305A and 305B, and downturned legs at 302A and 302B.

Figure 14:
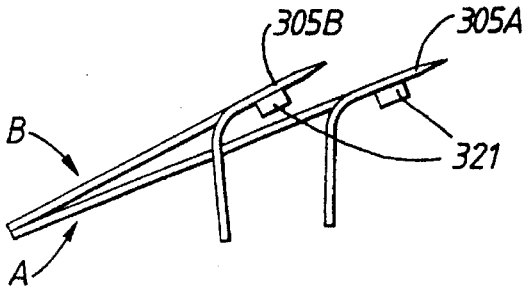
FIGS. 14 to 19 are side views of further forms of twin blade assembly according to the invention.
Figure 15:
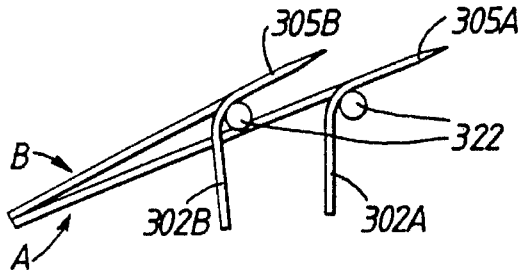

In FIG. 14, the strips 305A and B have bars 321 welded to their undersides and in FIG. 15 round wires 322 are welded to the blade members in the region of the "elbow" between the blade strips and the depending legs.

Figure 16:
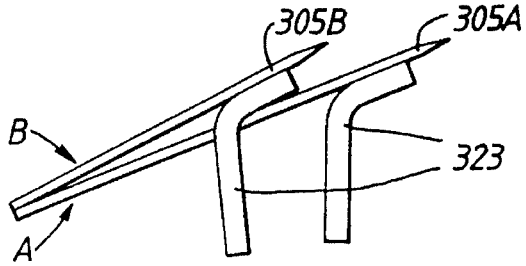

In FIG. 16, substituted angle-sections 323 are welded to the blade members.

Figure 17:
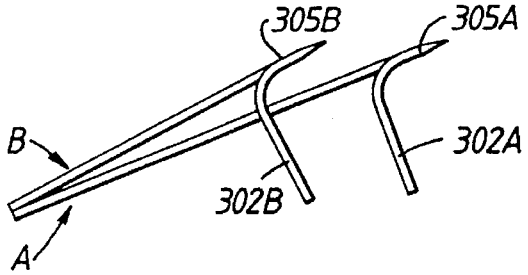
Figure 18:
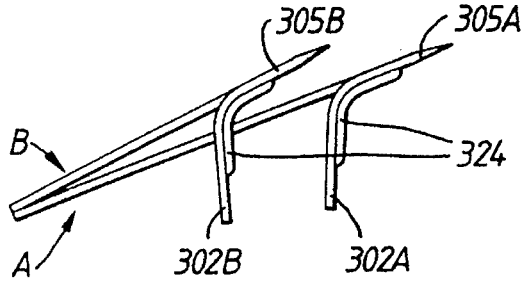

FIG. 17 shows the legs 302A, 302B set at 90° to the blade strips 305A, 305B and in FIG.18, the blade members are impressed to form localised ribs 324.

Figure 19:
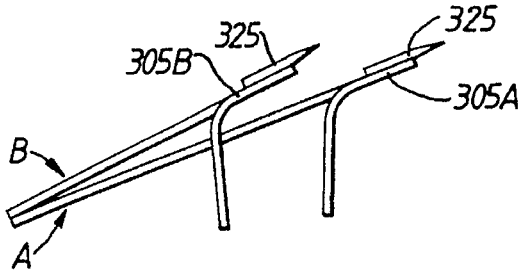

Finally, FIG. 19 illustrates a version in which separately formed narrow blades 325 are welded to the blade strips 305A, 305B.

These and many other variants will, of course, be possible within the scope of the present invention.

I claim:

1. A twin-blade assembly for use in a safety razor comprising two separately formed metallic blade members (A, B) each having a sharpened edge, said edges disposed parallel to one another in a spaced relationship, wherein said blade members are secured to each other for being mounted and replaced, as a unit, in a razor head, characterized in that at least one of said blade members (A, B) is resiliently flexible to allow the blade edges to be displaced relative to one another upon mounting the assembly in the razor head, and further characterized in that each said blade member (A, B) is formed of a blade steel blank and comprises a longitudinal rear margin (3 A/B) and a longitudinal generally planar blade strip (5 A/B), said blade strip having said sharpened blade edge (1 A/B) and being spaced forwardly of the rear margin and connected thereto by at least one integral spring arm (9 A/B) which is flexible about an axis parallel with said blade edges (1 A/B), and further characterized in that each blade member (A, B) has a reinforcing leg (2 A/B) formed as an integral part of the blank in an area between its corresponding generally planar blade strip and its corresponding rear margin and extending at an angle away from said generally planar blade strip such that a gap is formed between the blade strip (5 A/B) and said rear margin (3 A/B).

2. The twin-blade assembly according to claim 1, characterized in that portions of the blade members adjacent the sharpened edges include at least one local deformation of the material of those portions.

3. The twin-blade assembly according to claim 1 characterized in that portions of the blade members adjacent the sharpened edges include additional metal strips welded thereto.

4. A twin-blade assembly for use in a safety razor in combination with a razor head, said twin-blade assembly comprising two separately formed, metallic blade members (A, B) each having a sharpened edge (1A/B), wherein each said blade member (A, B) is formed of a blade steel blank shaped to comprise a longitudinal rear margin (3 A/B) and a longitudinal blade strip (5 A/B), said blade strip having said sharpened blade edge (1 A/B) and being spaced forwardly of the rear margin and connected thereto by at least one integral spring arm (9 A/B) which is flexible about an axis parallel with said blade edges (1 A/B), said blade edges facing in generally the same direction and being disposed parallel to one another in spaced relationship, wherein said blade members are secured to each other for being mounted and replaced, as a unit, in the razor head, characterized in that at least one of said blade members (A, B) is resiliently flexible to allow the blade members to be displaced about an axis parallel to at least one of said blade edges and at an acute angle relative to one another upon mounting the assembly in the razor head, said blade edges being displaced relative to one another in substantially parallel relationship and said acute angle having a vertex along one of said blade members along a projected line of intersection between said relatively displaced blade members, said razor head having a surface for contacting the skin of a user, and the assembly being removably received in the head, the head comprising a frame including a guard bar, and a cap movable between an open position permitting insertion of the assembly into the head, and a closed, operative position in which the assembly is clamped between the frame and the cap, said frame contacting the rear margin (3 A/B), and said cap having a bearing surface that in the closed, operative position engages a portion of each of said blade members to effect differential displacement of the blade strips (5A, 5B), with corresponding deflection of the spring arms (9A, 9B), to move the respective blade members apart.

5. The twin-blade assembly in combination with the razor head according to claim 4, characterized in that, in the closed operative position of the razor head, the blade strips (5 A/B) are independently moveable relative to each other against the restoring force action of said spring arms (9A, 9B).

6. A twin-blade assembly in combination with a razor head, said twin-blade assembly comprising two separately formed, metallic blade members (A, B) each having a sharpened edge, said edges facing in generally the same direction and being disposed parallel to one another in spaced relationship, wherein said blade members are secured to each other for being mounted and replaced, as a unit, in a razor head, characterized in that at least one of said blade members (A, B) is resiliently flexible to allow the blade members to be displaced at an acute angle relative to one another upon mounting the assembly in the razor head, said blade edges being displaced relative to one another in substantially parallel relationship, further characterized in that each said blade member (A, B) is formed of a blade steel blank shaped to comprise a longitudinal rear margin (3A/B) and a longitudinal blade strip (5A/B), said blade strip having said sharpened blade edge (1A/B) and being spaced forwardly of the rear margin and connected thereto by at least one integral spring arm (9A/B) which is flexible about an axis parallel with said blade edges (1A/B), said razor head comprising a surface for contacting the skin of a user, and the assembly being removably received in the head, the head comprising a frame including a guard bar, and a cap movable between an open position permitting insertion of the assembly into the head, and a closed, operative position in which the assembly is clamped between the frame and the cap, said cap having a bearing surface that in the closed, operative position engages a portion of said blade members to effect differential displacement of the blade strips (5A, 5B), with corresponding deflection of the spring arms (9A, 9B), to move the respective blade members apart, and further characterized in that said guard bar is disposed on a forward portion of said frame and is resiliently displaceable downwardly away from said skin contacting surface and rearwardly toward said blade edges in response to normal drag forces encountered by the guard bar during shaving, said guard bar further comprising a first bumper; and a second bumper disposed in said frame and having a surface for engaging said first bumper when said guard bar moves rearwardly;

said second bumper operatively engaging at least one of said blade members whereby the rearward motion of said guard bar is transmitted to said at least one of said blade members causing the orientation of the at least one blade member to change with respect to said skin contacting surface.

7. A twin-blade assembly for use in a safety razor in combination with a razor head, comprising:

a) a first and second generally planar steel blade member each having a longitudinal rear margin along a terminal peripheral portion of the blade member, a longitudinal blade strip having a sharpened blade edge spaced forwardly of said rear margin, each of said rear margins and said corresponding blade strips connected together by at least one integral arm;

b) said first and second blade members secured to each other in an area of said rear margins with each of said blade edges facing in the same direction in parallel, spaced relationship, said assembly adapted for mounting and replacement as a unit in the razor;

c) said at least one integral arm of said first blade member being resiliently deflectable with respect to said other at least one arm of said second blade member about said rear margin securement area about an axis parallel to at least one of said blade edges to allow the generally planar blade members to be displaced at an acute angle relative to one another upon mounting the assembly in the razor head, said blade strips being displaced relative to one another in substantially parallel relationship and said acute angle having a vertex along one of said generally planar blade members along a projected line of intersection between said relatively displaced generally planar blade members and d) said razor head having a surface for contacting the skin of a user, and the twinblade assembly being removably received in the head, the head comprising a frame including a guard bar, and a cap movable between an open position permitting insertion of the assembly into the head, and a closed, operative position in which the assembly is clamped between the frame and the cap, said frame contacting the rear margin, and said cap having a bearing surface that in the closed, operative position engages a portion of each of said blade members to effect differential displacement of the blade strips, with corresponding deflection of the integral arms, to move the respective blade members apart.

8. The twin-blade assembly in combination with the razor head according to claim 7, characterized in that, in the closed operative position of the razor head, the blade strips are independently moveable relative to each other against the restoring force action of said integral arms.

9. A twin-blade assembly for use in a safety razor comprising two separately formed metallic blade members (A, B) each having a sharpened edge facing in the same direction, said edges disposed parallel to one another in spaced relationship, wherein said blade members are secured to each other for being mounted and replaced, as a unit, in a razor head, characterized in that at least one of said blade members (A, B) is resiliently flexible to allow the blade members to be displaced at an acute angle relative to one another upon mounting the assembly in the razor head, said blade edges being displaced relative to one another in substantially parallel relationship, and further characterized in that each of said members (A, B) is formed of a blade steel blank and comprises a longitudinal rear margin (3 A/B) and a longitudinal generally planar blade strip (5 A/B), said blade strip having said sharpened edge (1 A/B) and being spaced forwardly of the rear margin and connected thereto by at least one integral spring arm (9 A/B) which is flexible about an axis parallel with said blade edges (1 A/B), and further characterized in that each blade member (A, B) has a reinforcing leg (2 A/B) formed as an integral part of the blank in an area between its corresponding generally planar blade strip and its corresponding rear margin and extending at an acute angle from said generally planar blade strip such that a gap is formed between the blade strip (5 A/B) and said rear margin (3 A/B), and further characterized in that the two blade members (A, B) are superposed with said leg (2 A) of one of said blade members (A) extending through said gap of the other blade member (B).

10. A twin-blade assembly for use in a safety razor comprising two separately formed, metallic blade members (A, B) each having a sharpened edge, said edges facing in generally the same direction and being disposed parallel to one another in spaced relationship, wherein said blade members are secured to each other for being mounted and replaced, as a unit, in a razor head, characterized in that at least one of said blade members (A, B) is resiliently flexible to allow the blade members to be displaced about an axis parallel to at least one of said blade edges and at an acute angle relative to one another upon mounting the assembly in the razor head, said blade edges being displaced relative to one another in substantially parallel relationship and said acute angle having a vertex along one of said blade members along a projected line of intersection between said relatively displaced blade members, and further characterized in that said twin-blade assembly further comprises a strip of lubricating material which is permanently attached to the blade members (A, B).

* * * * *